US007384243B2

(12) United States Patent
Noshi

(10) Patent No.: US 7,384,243 B2
(45) Date of Patent: Jun. 10, 2008

(54) STATOR VANE PROFILE OPTIMIZATION

(75) Inventor: Hani Ikram Noshi, Greenville, SC (US)

(73) Assignee: General Electric Company, Schenectady, NY (US)

( * ) Notice: Subject to any disclaimer, the term of this patent is extended or adjusted under 35 U.S.C. 154(b) by 500 days.

(21) Appl. No.: 11/214,499

(22) Filed: Aug. 30, 2005

(65) Prior Publication Data

US 2007/0048143 A1 Mar. 1, 2007

(51) Int. Cl.
*F01D 5/14* (2006.01)

(52) U.S. Cl. ..... 416/223 A; 416/DIG. 2

(58) Field of Classification Search ..... 416/223 A
See application file for complete search history.

(56) References Cited

U.S. PATENT DOCUMENTS 5,117,626 A 6/1992 North et al.
5,445,498 A 8/1995 Williams et al.
5,472,316 A 12/1995 Taslim et al.
5,980,209 A 11/1999 Barry et al.
6,461,110 B1 * 10/2002 By et al. ..... 416/223 A
6,739,838 B1 * 5/2004 Bielek et al. ..... 416/223 A
6,854,961 B2 2/2005 Zhang et al.
6,857,855 B1 2/2005 Snook et al.
6,881,038 B1 4/2005 Beddard et al.
6,887,041 B2 5/2005 Coke et al.
6,932,577 B2 8/2005 Strohl et al.
6,994,520 B2 2/2006 Humanchuk et al.
7,094,034 B2 8/2006 Fukuda et al.
7,186,090 B2 * 3/2007 Tomberg et al. ..... 416/223 A
2003/0017052 A1 * 1/2003 Frost et al. ..... 416/223 A
2004/0057833 A1 * 3/2004 Arness et al. ..... 416/243
2004/0115058 A1 * 6/2004 Lagrange et al. ..... 416/223 A

* cited by examiner

*Primary Examiner*—Edward Look
*Assistant Examiner*—Dwayne J White
(74) *Attorney, Agent, or Firm*—Armstrong Teasdale LLP

(57) ABSTRACT

An airfoil for a stator vane having an uncoated profile substantially in accordance with Cartesian coordinate values of X, Y and Z set forth in Table I is provided. The profile is carried only to three decimal places wherein Z is a distance from a platform on which the airfoil is mounted and X and Y are coordinates defining the profile at each distance Z from the platform.

17 Claims, 3 Drawing Sheets

STATOR VANE PROFILE OPTIMIZATION

BACKGROUND OF THE INVENTION

The present invention relates generally to stator vanes for gas turbines and, more particularly, to a novel and improved profile for a ninth stage compressor stator vane.

In the design, fabrication and use of turbine engines, there has been an increasing tendency toward operating with higher temperatures and higher operating pressures to optimize turbine performance. Also, as existing turbine airfoils and stator vanes reach the end of their life cycle, it is desirable to replace the airfoils, while simultaneously enhancing performance of the gas turbine through redesign of the airfoils to accommodate the increased operating temperatures and pressures.

Airfoil profiles for gas turbines have been proposed to provide improved performance, lower operating temperatures, increased creep margin and extended life in relation to conventional airfoils. See, for example, U.S. Pat. No. 5,980,209 describing an enhanced turbine blade airfoil profile. Advanced materials and new steam cooling systems now permit gas turbines to operate at, and accommodate, much higher operating temperatures, mechanical loading, and pressures than is capable in at least some known turbine engines. As a result, many system requirements must be met for each stage of each compressor used with the turbine engines in order to meet design goals including overall improved efficiency and airfoil loading. Particularly, the airfoils of the stator vanes positioned within the compressors must meet the thermal and mechanical operating requirements for each particular stage.

BRIEF DESCRIPTION OF THE INVENTION

In one aspect, an airfoil for a stator vane is provided. The airfoil has an uncoated profile substantially in accordance with Cartesian coordinate values of X, Y and Z set forth in Table I carried only to four decimal places wherein Z is a distance from a platform on which the airfoil is mounted and X and Y are coordinates defining the profile at each distance Z from the platform.

In another aspect, a compressor comprising at least one row of stator vanes is provided. Each of the stator vanes comprises a base and an airfoil extending therefrom. At least one of the airfoils has an airfoil shape. The airfoil shape has a nominal profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the platform.

In a further aspect, a stator assembly is provided. The stator assembly includes at least one stator vane including a base and an airfoil extending from the base. The airfoil has an uncoated profile substantially in accordance with Cartesian coordinate values of X, Y and Z set forth in Table I carried only to three decimal places wherein Z is a distance from a platform on which the airfoil is mounted and X and Y are coordinates defining the profile at each distance Z from the base. The profile is scalable by a predetermined constant n and manufacturable to a predetermined manufacturing tolerance.

DETAILED DESCRIPTION OF THE INVENTION

Figure 1:
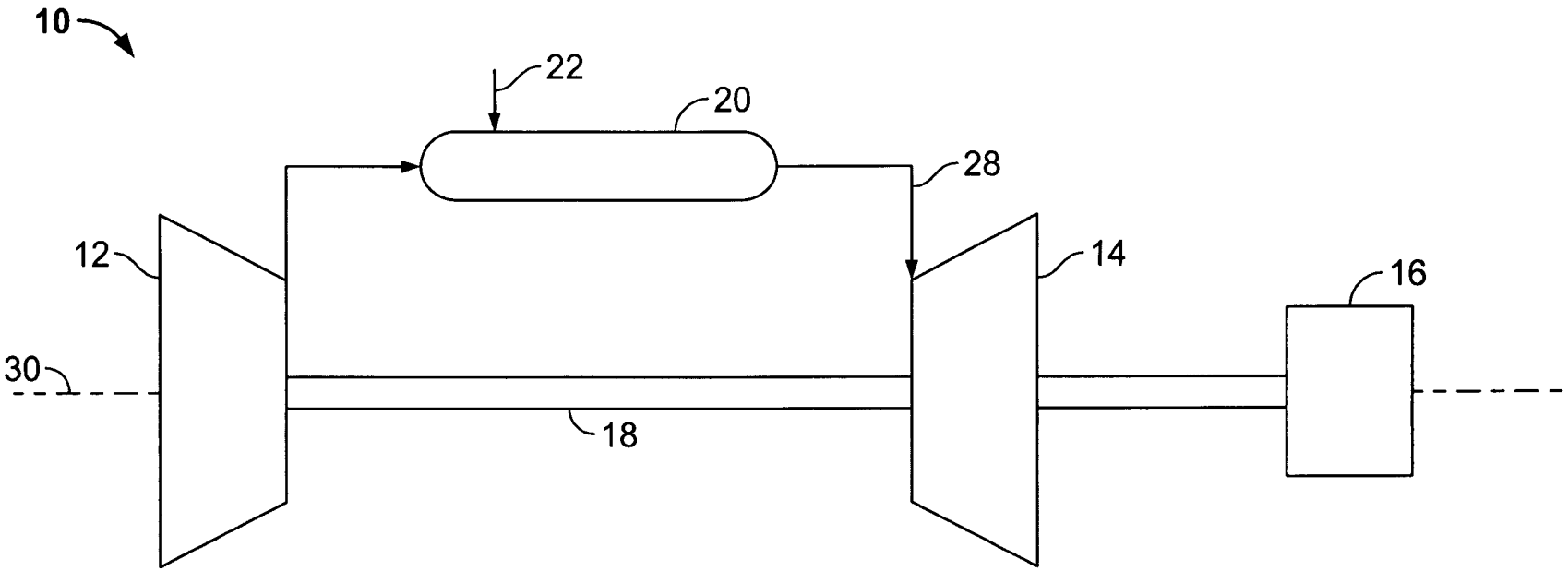
FIG. 1 is schematic illustration of an exemplary gas turbine engine.

FIG. 1 is a schematic illustration of an exemplary gas turbine engine 10 coupled to an electric generator 16. In the exemplary embodiment, gas turbine system 10 includes a compressor 12, a turbine 14, and generator 16 arranged in a single monolithic rotor or shaft 18. In an alternative embodiment, shaft 18 is segmented into a plurality of shaft segments, wherein each shaft segment is coupled to an adjacent shaft segment to form shaft 18. Compressor 12 supplies compressed air to a combustor 20 wherein the air is mixed with fuel 22 supplied thereto. In one embodiment, engine 10 is a 6C gas turbine engine commercially available from General Electric Company, Greenville, S.C.

In operation, air flows through compressor 12 and compressed air is supplied to combustor 20. Combustion gases 28 from combustor 20 propels turbines 14. Turbine 14 rotates shaft 18, compressor 12, and electric generator 16 about a longitudinal axis 30.

Figure 2:
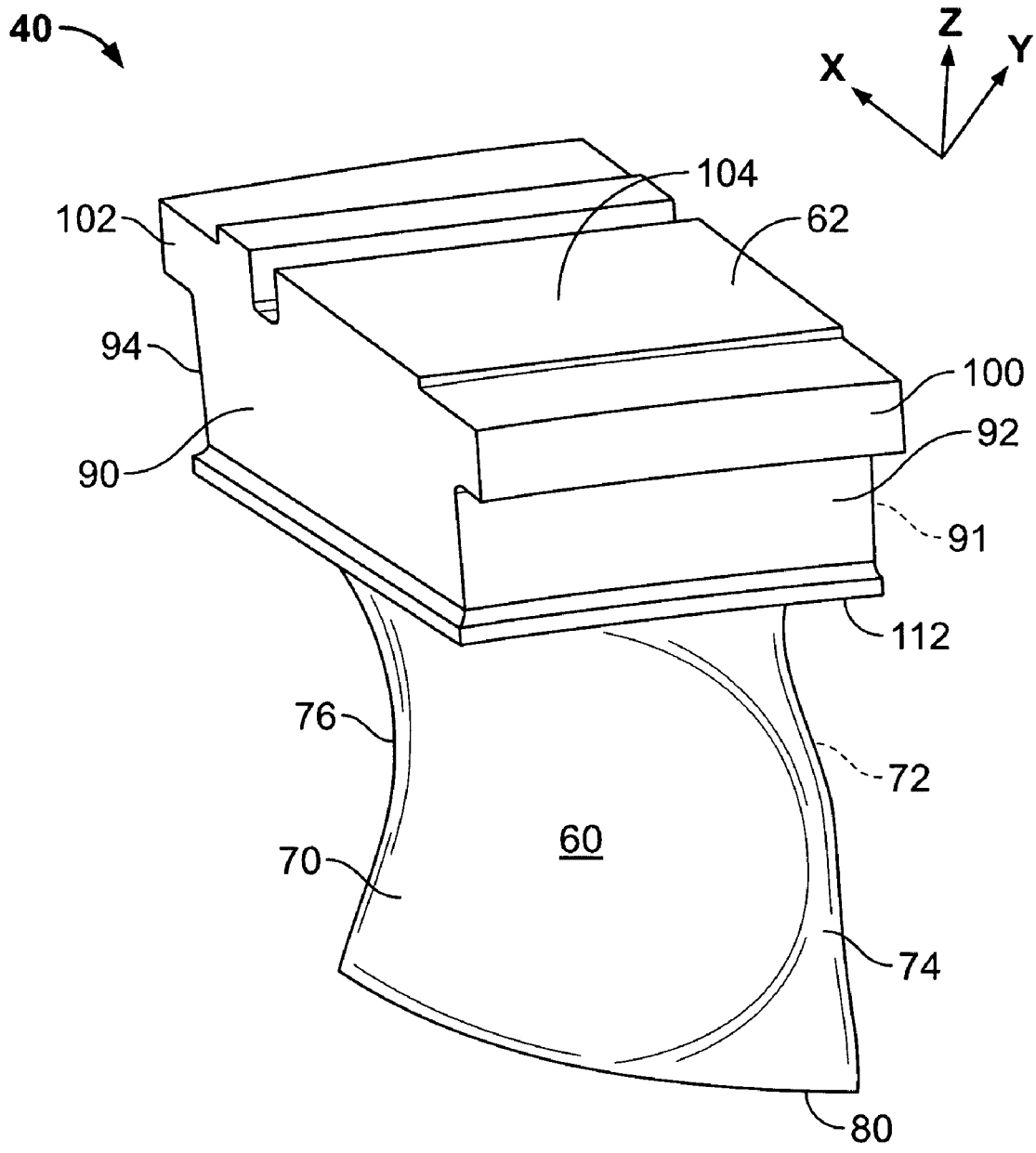
FIG. 2 is an enlarged perspective view of an exemplary stator vane that may be used with the gas turbine engine shown in FIG. 1.
Figure 3:
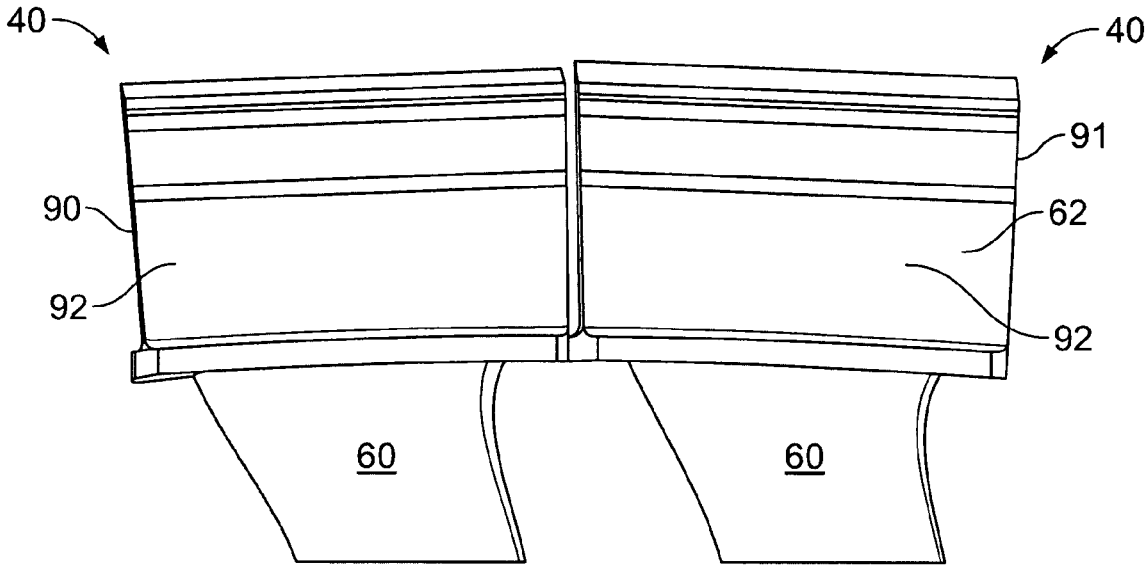
FIG. 3 is a front view of a pair of the stator vanes shown in FIG. 2 and illustrates a relative circumferential orientation of adjacent stator vanes as positioned when assembled within an engine, such as the gas turbine engine shown in FIG. 1.

FIG. 2 is an enlarged perspective view of an exemplary stator vane 40 that may be used with gas turbine engine 10 (shown in FIG. 1). More specifically, in the exemplary embodiment, stator vane 40 is coupled within a compressor, such as compressor 12 (shown in FIG. 1). FIG. 3 is a front view of a pair of stator vanes 40 and illustrates a relative circumferential orientation of adjacent stator vanes 40 when assembled within a rotor assembly, such as gas turbine engine 10 (shown in FIG. 1). In the exemplary embodiment, stator vane 40 forms a portion of a ninth stage of a compressor, such as compressor 12 (shown in FIG. 1). As will be appreciated by one of ordinary skill in the art, the stator vane described herein may be advantageous with other rotary member applications known in the art. The description herein is therefore set forth for illustrative purposes only and is not intended to limit application of the invention to a particular stator vane, compressor, or turbine.

The airfoil profile of the present invention, as described below, is believed to be optimal in the ninth stage of compressor 12 to achieve desired interaction between other stages in compressor 12, improve aerodynamic efficiency of compressor 12; and optimize aerodynamic and mechanical loading of each stator vane during compressor operation.

When assembled within the rotor assembly, each stator vane 40 is coupled to an engine casing (not shown) that extends circumferentially around a rotor shaft, such as shaft 18 (shown in FIG. 1). As is known in the art, when fully assembled, each circumferential row of stator vanes 40 is located axially between adjacent rows of rotor blades (not shown). More specifically, stator vanes 40 are oriented to channel a fluid flow through the rotor assembly in such a manner as to facilitate enhancing engine performance. In the exemplary embodiment, circumferentially adjacent stator vanes 40 are identical and each extends radially across a flow path defined within the rotor assembly. Moreover, each stator vane 40 includes an airfoil 60 that extends radially outward from, and in the exemplary embodiment, is formed integrally with, a base or platform 62.

Each airfoil 60 includes a first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74. First and second sidewalls 70 and 72, respectively, extend longitudinally or radially outward in span from a root 78 positioned adjacent base 62 to an airfoil tip 80.

Base 62 facilitates securing stator vanes 40 to the casing. In the exemplary embodiment, base 62 is known as a "square-faced" base and includes a pair of circumferentially-spaced sides 90 and 91 that are connected together by an upstream face 92 and a downstream face 94. In the exemplary embodiment, sides 90 and 91 are identical and are substantially parallel to each other. Moreover, in the exemplary embodiment, upstream face 92 and downstream face 94 are substantially parallel to each other.

A pair of integrally-formed hangers 100 and 102 extend from each respective face 92 and 94. Hangers 100 and 102, as is known in the art, engage the casing to facilitate securing stator vane 40 within the rotor assembly. In the exemplary embodiment, each hanger 100 and 102 extends outwardly from each respective face 92 and 94 adjacent a radially outer surface 104 of base 62.

In the exemplary embodiment, the airfoils 60 are integrally cast with each base 62 from a directionally solidified alloy which is strengthened through solution and precipitation hardening heat treatments. The directional solidification affords the advantage of avoiding transverse grain boundaries, thereby increasing creep life.

Via development of source codes, models and design practices, a loci of 1456 points in space that meet the unique demands of the ninth stage requirements of compressor 12 has been determined in an iterative process considering aerodynamic loading and mechanical loading of the blades under applicable operating parameters. The loci of points is believed to achieve a desired interaction between other stages in the compressor, aerodynamic efficiency of the compressor; and optimal aerodynamic and mechanical loading of the stator vanes during compressor operation. Additionally, the loci of points provide a manufacturable airfoil profile for fabrication of the stator vanes, and allows the compressor to run in an efficient, safe and smooth manner.

Referring to FIG. 2, there is shown a Cartesian coordinate system for X, Y and Z values set forth in Table I which follows. The Cartesian coordinate system has orthogonally related X, Y and Z axes with the Z axis or datum lying substantially perpendicular to platform 62 and extending generally in a radial direction through the airfoil. The Y axis lies parallel to the machine centerline, i.e., the rotary axis. By defining X and Y coordinate values at selected locations in the radial direction, i.e., in a Z direction, the profile of airfoil 60 can be ascertained. By connecting the X and Y values with smooth continuing arcs, each profile section at each radial distance Z is fixed. The surface profiles at the various surface locations between the radial distances Z can be ascertained by connecting adjacent profiles.

The X and Y coordinates for determining the airfoil section profile at each radial location or airfoil height Z are tabulated in the following Table I, where Z is a non-dimensionalized value equal to 0 at the upper surface of the platform 62 and equal to 1.593 at airfoil tip portion 80. Tabular values for X, Y, and Z coordinates are provided in inches, and represent actual airfoil profiles at ambient, non-operating or non-hot conditions for an uncoated airfoil, the coatings for which are described below. Additionally, the sign convention assigns a positive value to the value Z and positive and negative values for the coordinates X and Y, as typically used in a Cartesian coordinate system.

The Table I values are computer-generated and shown to three decimal places. However, in view of manufacturing constraints, actual values useful for forming the airfoil are considered valid to only three decimal places for determining the profile of the airfoil. Further, there are typical manufacturing tolerances which must be accounted for in the profile of the airfoil. Accordingly, the values for the profile given in Table I are for a nominal airfoil. It will therefore be appreciated that plus or minus typical manufacturing tolerances are applicable to these X, Y and Z values and that an airfoil having a profile substantially in accordance with those values includes such tolerances. For example, a manufacturing tolerance of about ±0.160 inches is within design limits for the airfoil. Thus, the mechanical and aerodynamic function of the airfoils is not impaired by manufacturing imperfections and tolerances, which in different embodiments may be greater or lesser than the values set forth above. As appreciated by those in the art, manufacturing tolerances may be determined to achieve a desired mean and standard deviation of manufactured airfoils in relation to the ideal airfoil profile points set forth in Table 1.

In addition, and as noted previously, the airfoil may also be coated for protection against corrosion and oxidation after the airfoil is manufactured, according to the values of Table I and within the tolerances explained above. In an exemplary embodiment, an anti-corrosion coating or coatings is provided with a total average thickness of about 0.100 inches. Consequently, in addition to the manufacturing tolerances for the X and Y values set forth in Table I, there is also an addition to those values to account for the coating thicknesses. It is contemplated that greater or lesser coating thickness values may be employed in alternative embodiments of the invention.

As the ninth stage stator vane assembly, including the aforementioned airfoils, heats up during operation, applied stress and temperature on the turbine blades inevitably leads to some deformation of the airfoil shape, and hence there is some change or displacement in the X, Y and Z coordinates set forth in Table 1 as the engine is operated. While it is not possible to measure the changes in the airfoil coordinates in operation, it has been determined that the loci of points set forth in Table 1 plus the deformation in use, allows the compressor to run in an efficient, safe and smooth manner.

It is appreciated that the airfoil profile set forth in Table 1 may be scaled up or down geometrically in order to be introduced into other similar machine designs. It is therefore contemplated that a scaled version of the airfoil profile set fort in Table 1 may be obtained by multiplying or dividing each of the X and Y coordinate values by a predetermined constant n. It is recognized that Table 1 could be considered a scaled profile with n set equal to 1, and greater or lesser dimensioned airfoils could be obtained by adjusting n to values greater and lesser than 1, respectively.

The above-described stator vanes provide a cost-effective and reliable method for optimizing performance of a rotor assembly. More specifically, each stator vane airfoil has an airfoil shape that facilitates achieving a desired interaction between other stages in the compressor, aerodynamic efficiency of the compressor; and optimal aerodynamic and mechanical loading of the stator vanes during compressor operation. As a result, the redefined airfoil geometry facilitates extending a useful life of the stator assembly and improving the operating efficiency of the compressor in a cost-effective and reliable manner.

Exemplary embodiments of stator vanes and stator assemblies are described above in detail. The stator vanes are not limited to the specific embodiments described herein, but rather, components of each stator vane may be utilized independently and separately from other components described herein. For example, each stator vane recessed portion can also be defined in, or used in combination with, other stator vanes or with other rotor assemblies, and is not limited to practice with only stator vane 40 as described herein. Rather, the present invention can be implemented and utilized in connection with many other vane and rotor configurations.

While the invention has been described in terms of various specific embodiments, those skilled in the art will recognize that the invention can be practiced with modification within the spirit and scope of the claims.

TABLE 1

| X-LOC | Y-LOC | Z-LOC |
|---|---|---|
| 0.61 | −0.717 | 0 |
| 0.61 | −0.718 | 0 |
| 0.609 | −0.719 | 0 |
| 0.607 | −0.722 | 0 |
| 0.603 | −0.724 | 0 |
| 0.595 | −0.726 | 0 |
| 0.584 | −0.722 | 0 |
| 0.57 | −0.717 | 0 |
| 0.553 | −0.711 | 0 |
| 0.529 | −0.703 | 0 |
| 0.503 | −0.693 | 0 |
| 0.474 | −0.684 | 0 |
| 0.442 | −0.673 | 0 |
| 0.407 | −0.66 | 0 |
| 0.368 | −0.647 | 0 |
| 0.327 | −0.632 | 0 |
| 0.284 | −0.617 | 0 |
| 0.24 | −0.6 | 0 |
| 0.195 | −0.583 | 0 |
| 0.148 | −0.564 | 0 |
| 0.099 | −0.543 | 0 |
| 0.049 | −0.522 | 0 |
| −0.002 | −0.498 | 0 |
| −0.053 | −0.474 | 0 |
| −0.104 | −0.449 | 0 |
| −0.154 | −0.422 | 0 |
| −0.203 | −0.394 | 0 |
| −0.251 | −0.366 | 0 |
| −0.299 | −0.335 | 0 |
| −0.346 | −0.304 | 0 |
| −0.392 | −0.271 | 0 |
| −0.436 | −0.237 | 0 |
| −0.479 | −0.201 | 0 |
| −0.521 | −0.163 | 0 |
| −0.559 | −0.125 | 0 |
| −0.594 | −0.086 | 0 |
| −0.627 | −0.047 | 0 |
| −0.657 | −0.008 | 0 |
| −0.684 | 0.03 | 0 |
| −0.708 | 0.068 | 0 |
| −0.73 | 0.106 | 0 |
| −0.748 | 0.141 | 0 |
| −0.764 | 0.173 | 0 |
| −0.776 | 0.203 | 0 |
| −0.786 | 0.229 | 0 |
| −0.794 | 0.252 | 0 |
| −0.8 | 0.272 | 0 |
| −0.805 | 0.289 | 0 |
| −0.808 | 0.303 | 0 |

TABLE 1-continued

| X-LOC | Y-LOC | Z-LOC |
|---|---|---|
| −0.811 | 0.316 | 0 |
| −0.812 | 0.325 | 0 |
| −0.813 | 0.333 | 0 |
| −0.813 | 0.339 | 0 |
| −0.812 | 0.343 | 0 |
| −0.81 | 0.346 | 0 |
| −0.807 | 0.348 | 0 |
| −0.805 | 0.349 | 0 |
| −0.801 | 0.348 | 0 |
| −0.797 | 0.346 | 0 |
| −0.793 | 0.342 | 0 |
| −0.788 | 0.336 | 0 |
| −0.783 | 0.329 | 0 |
| −0.776 | 0.32 | 0 |
| −0.768 | 0.308 | 0 |
| −0.759 | 0.294 | 0 |
| −0.748 | 0.277 | 0 |
| −0.735 | 0.257 | 0 |
| −0.719 | 0.235 | 0 |
| −0.701 | 0.21 | 0 |
| −0.68 | 0.183 | 0 |
| −0.656 | 0.154 | 0 |
| −0.629 | 0.123 | 0 |
| −0.599 | 0.092 | 0 |
| −0.568 | 0.06 | 0 |
| −0.534 | 0.027 | 0 |
| −0.498 | −0.006 | 0 |
| −0.46 | −0.039 | 0 |
| −0.42 | −0.072 | 0 |
| −0.377 | −0.106 | 0 |
| −0.335 | −0.139 | 0 |
| −0.292 | −0.171 | 0 |
| −0.248 | −0.202 | 0 |
| −0.204 | −0.233 | 0 |
| −0.159 | −0.264 | 0 |
| −0.114 | −0.294 | 0 |
| −0.069 | −0.323 | 0 |
| −0.023 | −0.352 | 0 |
| 0.022 | −0.381 | 0 |
| 0.068 | −0.409 | 0 |
| 0.114 | −0.437 | 0 |
| 0.159 | −0.464 | 0 |
| 0.203 | −0.489 | 0 |
| 0.245 | −0.513 | 0 |
| 0.286 | −0.536 | 0 |
| 0.325 | −0.558 | 0 |
| 0.363 | −0.579 | 0 |
| 0.399 | −0.598 | 0 |
| 0.435 | −0.617 | 0 |
| 0.467 | −0.633 | 0 |
| 0.495 | −0.648 | 0 |
| 0.521 | −0.661 | 0 |
| 0.546 | −0.672 | 0 |
| 0.567 | −0.682 | 0 |
| 0.583 | −0.69 | 0 |
| 0.596 | −0.695 | 0 |
| 0.606 | −0.7 | 0 |
| 0.61 | −0.707 | 0 |
| 0.611 | −0.711 | 0 |
| 0.611 | −0.714 | 0 |
| 0.61 | −0.716 | 0 |
| 0.61 | −0.716 | 0 |
| 0.61 | −0.717 | 0 |
| 0.628 | −0.707 | 0.037 |
| 0.627 | −0.707 | 0.037 |
| 0.627 | −0.709 | 0.037 |
| 0.625 | −0.711 | 0.037 |
| 0.621 | −0.714 | 0.037 |
| 0.613 | −0.715 | 0.037 |
| 0.602 | −0.712 | 0.037 |
| 0.588 | −0.707 | 0.037 |
| 0.571 | −0.7 | 0.037 |
| 0.548 | −0.692 | 0.037 |
| 0.521 | −0.682 | 0.037 |
| 0.493 | −0.672 | 0.037 |
| 0.461 | −0.661 | 0.037 |
| 0.425 | −0.648 | 0.037 |

TABLE 1-continued

| X-LOC | Y-LOC | Z-LOC |
|---|---|---|
| 0.386 | −0.634 | 0.037 |
| 0.346 | −0.619 | 0.037 |
| 0.303 | −0.603 | 0.037 |
| 0.259 | −0.586 | 0.037 |
| 0.214 | −0.568 | 0.037 |
| 0.167 | −0.549 | 0.037 |
| 0.118 | −0.529 | 0.037 |
| 0.068 | −0.507 | 0.037 |
| 0.017 | −0.483 | 0.037 |
| −0.034 | −0.459 | 0.037 |
| −0.085 | −0.434 | 0.037 |
| −0.135 | −0.407 | 0.037 |
| −0.184 | −0.38 | 0.037 |
| −0.233 | −0.351 | 0.037 |
| −0.281 | −0.322 | 0.037 |
| −0.328 | −0.29 | 0.037 |
| −0.374 | −0.258 | 0.037 |
| −0.419 | −0.224 | 0.037 |
| −0.463 | −0.189 | 0.037 |
| −0.505 | −0.151 | 0.037 |
| −0.545 | −0.113 | 0.037 |
| −0.581 | −0.075 | 0.037 |
| −0.615 | −0.037 | 0.037 |
| −0.645 | 0.001 | 0.037 |
| −0.674 | 0.038 | 0.037 |
| −0.699 | 0.076 | 0.037 |
| −0.722 | 0.113 | 0.037 |
| −0.741 | 0.147 | 0.037 |
| −0.758 | 0.179 | 0.037 |
| −0.771 | 0.207 | 0.037 |
| −0.782 | 0.233 | 0.037 |
| −0.791 | 0.256 | 0.037 |
| −0.797 | 0.276 | 0.037 |
| −0.803 | 0.293 | 0.037 |
| −0.807 | 0.307 | 0.037 |
| −0.81 | 0.319 | 0.037 |
| −0.811 | 0.329 | 0.037 |
| −0.812 | 0.336 | 0.037 |
| −0.812 | 0.342 | 0.037 |
| −0.811 | 0.347 | 0.037 |
| −0.809 | 0.35 | 0.037 |
| −0.807 | 0.351 | 0.037 |
| −0.804 | 0.352 | 0.037 |
| −0.801 | 0.351 | 0.037 |
| −0.797 | 0.349 | 0.037 |
| −0.793 | 0.346 | 0.037 |
| −0.788 | 0.341 | 0.037 |
| −0.782 | 0.333 | 0.037 |
| −0.774 | 0.324 | 0.037 |
| −0.766 | 0.312 | 0.037 |
| −0.756 | 0.299 | 0.037 |
| −0.745 | 0.282 | 0.037 |
| −0.731 | 0.263 | 0.037 |
| −0.714 | 0.242 | 0.037 |
| −0.695 | 0.217 | 0.037 |
| −0.673 | 0.191 | 0.037 |
| −0.648 | 0.163 | 0.037 |
| −0.62 | 0.132 | 0.037 |
| −0.589 | 0.101 | 0.037 |
| −0.557 | 0.07 | 0.037 |
| −0.522 | 0.038 | 0.037 |
| −0.486 | 0.006 | 0.037 |
| −0.447 | −0.027 | 0.037 |
| −0.406 | −0.06 | 0.037 |
| −0.364 | −0.093 | 0.037 |
| −0.321 | −0.126 | 0.037 |
| −0.277 | −0.158 | 0.037 |
| −0.233 | −0.189 | 0.037 |
| −0.188 | −0.22 | 0.037 |
| −0.143 | −0.25 | 0.037 |
| −0.098 | −0.28 | 0.037 |
| −0.053 | −0.31 | 0.037 |
| −0.007 | −0.339 | 0.037 |
| 0.039 | −0.367 | 0.037 |
| 0.085 | −0.395 | 0.037 |
| 0.132 | −0.423 | 0.037 |
| 0.177 | −0.45 | 0.037 |

TABLE 1-continued

| X-LOC | Y-LOC | Z-LOC |
|---|---|---|
| 0.221 | −0.475 | 0.037 |
| 0.263 | −0.5 | 0.037 |
| 0.304 | −0.523 | 0.037 |
| 0.343 | −0.545 | 0.037 |
| 0.381 | −0.566 | 0.037 |
| 0.417 | −0.586 | 0.037 |
| 0.452 | −0.605 | 0.037 |
| 0.484 | −0.621 | 0.037 |
| 0.513 | −0.636 | 0.037 |
| 0.539 | −0.649 | 0.037 |
| 0.564 | −0.661 | 0.037 |
| 0.585 | −0.671 | 0.037 |
| 0.601 | −0.679 | 0.037 |
| 0.614 | −0.685 | 0.037 |
| 0.624 | −0.69 | 0.037 |
| 0.628 | −0.697 | 0.037 |
| 0.629 | −0.701 | 0.037 |
| 0.629 | −0.704 | 0.037 |
| 0.628 | −0.705 | 0.037 |
| 0.628 | −0.706 | 0.037 |
| 0.628 | −0.706 | 0.037 |
| 0.651 | −0.693 | 0.073 |
| 0.651 | −0.693 | 0.073 |
| 0.65 | −0.695 | 0.073 |
| 0.648 | −0.697 | 0.073 |
| 0.645 | −0.7 | 0.073 |
| 0.636 | −0.702 | 0.073 |
| 0.626 | −0.698 | 0.073 |
| 0.611 | −0.692 | 0.073 |
| 0.594 | −0.686 | 0.073 |
| 0.571 | −0.677 | 0.073 |
| 0.544 | −0.668 | 0.073 |
| 0.516 | −0.658 | 0.073 |
| 0.483 | −0.646 | 0.073 |
| 0.448 | −0.633 | 0.073 |
| 0.409 | −0.619 | 0.073 |
| 0.368 | −0.605 | 0.073 |
| 0.325 | −0.589 | 0.073 |
| 0.281 | −0.572 | 0.073 |
| 0.235 | −0.554 | 0.073 |
| 0.188 | −0.535 | 0.073 |
| 0.139 | −0.514 | 0.073 |
| 0.089 | −0.493 | 0.073 |
| 0.037 | −0.469 | 0.073 |
| −0.014 | −0.445 | 0.073 |
| −0.065 | −0.42 | 0.073 |
| −0.115 | −0.394 | 0.073 |
| −0.165 | −0.366 | 0.073 |
| −0.214 | −0.338 | 0.073 |
| −0.262 | −0.308 | 0.073 |
| −0.309 | −0.277 | 0.073 |
| −0.356 | −0.245 | 0.073 |
| −0.402 | −0.212 | 0.073 |
| −0.447 | −0.177 | 0.073 |
| −0.49 | −0.14 | 0.073 |
| −0.53 | −0.103 | 0.073 |
| −0.567 | −0.066 | 0.073 |
| −0.602 | −0.028 | 0.073 |
| −0.634 | 0.009 | 0.073 |
| −0.663 | 0.046 | 0.073 |
| −0.689 | 0.083 | 0.073 |
| −0.713 | 0.119 | 0.073 |
| −0.734 | 0.153 | 0.073 |
| −0.751 | 0.184 | 0.073 |
| −0.766 | 0.213 | 0.073 |
| −0.778 | 0.238 | 0.073 |
| −0.787 | 0.261 | 0.073 |
| −0.795 | 0.28 | 0.073 |
| −0.801 | 0.297 | 0.073 |
| −0.805 | 0.311 | 0.073 |
| −0.808 | 0.323 | 0.073 |
| −0.81 | 0.333 | 0.073 |
| −0.811 | 0.34 | 0.073 |
| −0.812 | 0.346 | 0.073 |
| −0.811 | 0.351 | 0.073 |
| −0.809 | 0.354 | 0.073 |
| −0.807 | 0.356 | 0.073 |

TABLE 1-continued

| X-LOC | Y-LOC | Z-LOC |
|---|---|---|
| −0.804 | 0.357 | 0.073 |
| −0.8 | 0.356 | 0.073 |
| −0.796 | 0.354 | 0.073 |
| −0.792 | 0.351 | 0.073 |
| −0.787 | 0.346 | 0.073 |
| −0.78 | 0.339 | 0.073 |
| −0.773 | 0.33 | 0.073 |
| −0.764 | 0.318 | 0.073 |
| −0.754 | 0.305 | 0.073 |
| −0.741 | 0.289 | 0.073 |
| −0.727 | 0.27 | 0.073 |
| −0.71 | 0.249 | 0.073 |
| −0.69 | 0.225 | 0.073 |
| −0.667 | 0.199 | 0.073 |
| −0.641 | 0.171 | 0.073 |
| −0.611 | 0.142 | 0.073 |
| −0.58 | 0.111 | 0.073 |
| −0.547 | 0.08 | 0.073 |
| −0.511 | 0.049 | 0.073 |
| −0.474 | 0.017 | 0.073 |
| −0.435 | −0.015 | 0.073 |
| −0.393 | −0.048 | 0.073 |
| −0.35 | −0.081 | 0.073 |
| −0.306 | −0.114 | 0.073 |
| −0.262 | −0.146 | 0.073 |
| −0.218 | −0.177 | 0.073 |
| −0.173 | −0.208 | 0.073 |
| −0.127 | −0.238 | 0.073 |
| −0.081 | −0.268 | 0.073 |
| −0.036 | −0.297 | 0.073 |
| 0.011 | −0.326 | 0.073 |
| 0.057 | −0.354 | 0.073 |
| 0.104 | −0.382 | 0.073 |
| 0.151 | −0.41 | 0.073 |
| 0.196 | −0.437 | 0.073 |
| 0.24 | −0.462 | 0.073 |
| 0.283 | −0.486 | 0.073 |
| 0.324 | −0.509 | 0.073 |
| 0.364 | −0.531 | 0.073 |
| 0.402 | −0.552 | 0.073 |
| 0.439 | −0.572 | 0.073 |
| 0.475 | −0.591 | 0.073 |
| 0.507 | −0.607 | 0.073 |
| 0.536 | −0.622 | 0.073 |
| 0.562 | −0.635 | 0.073 |
| 0.587 | −0.647 | 0.073 |
| 0.608 | −0.657 | 0.073 |
| 0.624 | −0.665 | 0.073 |
| 0.638 | −0.671 | 0.073 |
| 0.647 | −0.676 | 0.073 |
| 0.652 | −0.683 | 0.073 |
| 0.652 | −0.687 | 0.073 |
| 0.652 | −0.69 | 0.073 |
| 0.652 | −0.691 | 0.073 |
| 0.651 | −0.692 | 0.073 |
| 0.651 | −0.692 | 0.073 |
| 0.698 | −0.663 | 0.145 |
| 0.698 | −0.664 | 0.145 |
| 0.697 | −0.665 | 0.145 |
| 0.695 | −0.668 | 0.145 |
| 0.692 | −0.671 | 0.145 |
| 0.683 | −0.672 | 0.145 |
| 0.672 | −0.668 | 0.145 |
| 0.658 | −0.663 | 0.145 |
| 0.64 | −0.656 | 0.145 |
| 0.617 | −0.648 | 0.145 |
| 0.59 | −0.638 | 0.145 |
| 0.561 | −0.628 | 0.145 |
| 0.528 | −0.617 | 0.145 |
| 0.492 | −0.604 | 0.145 |
| 0.453 | −0.59 | 0.145 |
| 0.411 | −0.576 | 0.145 |
| 0.368 | −0.56 | 0.145 |
| 0.324 | −0.543 | 0.145 |
| 0.277 | −0.525 | 0.145 |
| 0.229 | −0.506 | 0.145 |
| 0.18 | −0.486 | 0.145 |

TABLE 1-continued

| X-LOC | Y-LOC | Z-LOC |
|---|---|---|
| 0.129 | −0.464 | 0.145 |
| 0.077 | −0.441 | 0.145 |
| 0.025 | −0.417 | 0.145 |
| −0.027 | −0.392 | 0.145 |
| −0.078 | −0.366 | 0.145 |
| −0.128 | −0.339 | 0.145 |
| −0.178 | −0.311 | 0.145 |
| −0.227 | −0.281 | 0.145 |
| −0.276 | −0.251 | 0.145 |
| −0.324 | −0.22 | 0.145 |
| −0.371 | −0.187 | 0.145 |
| −0.417 | −0.153 | 0.145 |
| −0.461 | −0.117 | 0.145 |
| −0.503 | −0.081 | 0.145 |
| −0.542 | −0.044 | 0.145 |
| −0.579 | −0.008 | 0.145 |
| −0.612 | 0.029 | 0.145 |
| −0.643 | 0.065 | 0.145 |
| −0.672 | 0.101 | 0.145 |
| −0.698 | 0.136 | 0.145 |
| −0.72 | 0.169 | 0.145 |
| −0.74 | 0.2 | 0.145 |
| −0.756 | 0.228 | 0.145 |
| −0.769 | 0.253 | 0.145 |
| −0.78 | 0.275 | 0.145 |
| −0.789 | 0.294 | 0.145 |
| −0.796 | 0.311 | 0.145 |
| −0.801 | 0.325 | 0.145 |
| −0.806 | 0.337 | 0.145 |
| −0.808 | 0.346 | 0.145 |
| −0.81 | 0.354 | 0.145 |
| −0.81 | 0.359 | 0.145 |
| −0.81 | 0.364 | 0.145 |
| −0.808 | 0.368 | 0.145 |
| −0.806 | 0.37 | 0.145 |
| −0.803 | 0.371 | 0.145 |
| −0.8 | 0.37 | 0.145 |
| −0.795 | 0.368 | 0.145 |
| −0.791 | 0.365 | 0.145 |
| −0.785 | 0.36 | 0.145 |
| −0.778 | 0.354 | 0.145 |
| −0.77 | 0.345 | 0.145 |
| −0.761 | 0.334 | 0.145 |
| −0.749 | 0.321 | 0.145 |
| −0.736 | 0.306 | 0.145 |
| −0.72 | 0.288 | 0.145 |
| −0.701 | 0.267 | 0.145 |
| −0.68 | 0.244 | 0.145 |
| −0.655 | 0.219 | 0.145 |
| −0.628 | 0.192 | 0.145 |
| −0.597 | 0.163 | 0.145 |
| −0.564 | 0.133 | 0.145 |
| −0.529 | 0.103 | 0.145 |
| −0.492 | 0.072 | 0.145 |
| −0.454 | 0.041 | 0.145 |
| −0.413 | 0.009 | 0.145 |
| −0.37 | −0.023 | 0.145 |
| −0.326 | −0.056 | 0.145 |
| −0.281 | −0.088 | 0.145 |
| −0.236 | −0.12 | 0.145 |
| −0.19 | −0.151 | 0.145 |
| −0.144 | −0.182 | 0.145 |
| −0.097 | −0.212 | 0.145 |
| −0.051 | −0.241 | 0.145 |
| −0.004 | −0.271 | 0.145 |
| 0.043 | −0.299 | 0.145 |
| 0.091 | −0.328 | 0.145 |
| 0.139 | −0.356 | 0.145 |
| 0.186 | −0.384 | 0.145 |
| 0.233 | −0.41 | 0.145 |
| 0.278 | −0.435 | 0.145 |
| 0.322 | −0.459 | 0.145 |
| 0.364 | −0.482 | 0.145 |
| 0.404 | −0.504 | 0.145 |
| 0.444 | −0.524 | 0.145 |
| 0.481 | −0.544 | 0.145 |
| 0.517 | −0.562 | 0.145 |

TABLE 1-continued

| X-LOC | Y-LOC | Z-LOC |
|---|---|---|
| 0.55 | −0.579 | 0.145 |
| 0.58 | −0.593 | 0.145 |
| 0.607 | −0.606 | 0.145 |
| 0.632 | −0.618 | 0.145 |
| 0.654 | −0.628 | 0.145 |
| 0.671 | −0.635 | 0.145 |
| 0.684 | −0.641 | 0.145 |
| 0.694 | −0.646 | 0.145 |
| 0.699 | −0.653 | 0.145 |
| 0.699 | −0.658 | 0.145 |
| 0.699 | −0.66 | 0.145 |
| 0.699 | −0.662 | 0.145 |
| 0.698 | −0.663 | 0.145 |
| 0.698 | −0.663 | 0.145 |
| 0.794 | −0.578 | 0.338 |
| 0.793 | −0.579 | 0.338 |
| 0.793 | −0.58 | 0.338 |
| 0.791 | −0.583 | 0.338 |
| 0.787 | −0.586 | 0.338 |
| 0.779 | −0.587 | 0.338 |
| 0.767 | −0.584 | 0.338 |
| 0.752 | −0.579 | 0.338 |
| 0.734 | −0.573 | 0.338 |
| 0.71 | −0.565 | 0.338 |
| 0.682 | −0.556 | 0.338 |
| 0.652 | −0.546 | 0.338 |
| 0.618 | −0.536 | 0.338 |
| 0.581 | −0.524 | 0.338 |
| 0.54 | −0.51 | 0.338 |
| 0.498 | −0.496 | 0.338 |
| 0.453 | −0.481 | 0.338 |
| 0.407 | −0.465 | 0.338 |
| 0.359 | −0.447 | 0.338 |
| 0.31 | −0.429 | 0.338 |
| 0.259 | −0.409 | 0.338 |
| 0.206 | −0.388 | 0.338 |
| 0.152 | −0.365 | 0.338 |
| 0.099 | −0.342 | 0.338 |
| 0.045 | −0.317 | 0.338 |
| −0.008 | −0.292 | 0.338 |
| −0.06 | −0.266 | 0.338 |
| −0.112 | −0.239 | 0.338 |
| −0.163 | −0.211 | 0.338 |
| −0.214 | −0.181 | 0.338 |
| −0.264 | −0.151 | 0.338 |
| −0.314 | −0.119 | 0.338 |
| −0.362 | −0.086 | 0.338 |
| −0.409 | −0.052 | 0.338 |
| −0.454 | −0.017 | 0.338 |
| −0.496 | 0.018 | 0.338 |
| −0.536 | 0.053 | 0.338 |
| −0.573 | 0.088 | 0.338 |
| −0.607 | 0.122 | 0.338 |
| −0.639 | 0.157 | 0.338 |
| −0.668 | 0.191 | 0.338 |
| −0.694 | 0.222 | 0.338 |
| −0.717 | 0.252 | 0.338 |
| −0.736 | 0.279 | 0.338 |
| −0.753 | 0.303 | 0.338 |
| −0.766 | 0.324 | 0.338 |
| −0.777 | 0.343 | 0.338 |
| −0.786 | 0.359 | 0.338 |
| −0.793 | 0.373 | 0.338 |
| −0.799 | 0.384 | 0.338 |
| −0.803 | 0.393 | 0.338 |
| −0.805 | 0.401 | 0.338 |
| −0.807 | 0.407 | 0.338 |
| −0.807 | 0.412 | 0.338 |
| −0.806 | 0.415 | 0.338 |
| −0.804 | 0.418 | 0.338 |
| −0.802 | 0.419 | 0.338 |
| −0.798 | 0.419 | 0.338 |
| −0.793 | 0.417 | 0.338 |
| −0.788 | 0.414 | 0.338 |
| −0.782 | 0.41 | 0.338 |
| −0.775 | 0.403 | 0.338 |
| −0.765 | 0.395 | 0.338 |

TABLE 1-continued

| X-LOC | Y-LOC | Z-LOC |
|---|---|---|
| −0.754 | 0.385 | 0.338 |
| −0.741 | 0.372 | 0.338 |
| −0.726 | 0.358 | 0.338 |
| −0.708 | 0.341 | 0.338 |
| −0.687 | 0.322 | 0.338 |
| −0.663 | 0.3 | 0.338 |
| −0.636 | 0.276 | 0.338 |
| −0.606 | 0.25 | 0.338 |
| −0.572 | 0.222 | 0.338 |
| −0.537 | 0.193 | 0.338 |
| −0.5 | 0.164 | 0.338 |
| −0.46 | 0.134 | 0.338 |
| −0.419 | 0.103 | 0.338 |
| −0.376 | 0.072 | 0.338 |
| −0.331 | 0.041 | 0.338 |
| −0.284 | 0.009 | 0.338 |
| −0.236 | −0.023 | 0.338 |
| −0.189 | −0.054 | 0.338 |
| −0.14 | −0.085 | 0.338 |
| −0.092 | −0.114 | 0.338 |
| −0.043 | −0.144 | 0.338 |
| 0.006 | −0.173 | 0.338 |
| 0.055 | −0.201 | 0.338 |
| 0.105 | −0.229 | 0.338 |
| 0.155 | −0.257 | 0.338 |
| 0.205 | −0.284 | 0.338 |
| 0.255 | −0.311 | 0.338 |
| 0.304 | −0.337 | 0.338 |
| 0.351 | −0.361 | 0.338 |
| 0.397 | −0.384 | 0.338 |
| 0.441 | −0.406 | 0.338 |
| 0.484 | −0.427 | 0.338 |
| 0.525 | −0.447 | 0.338 |
| 0.565 | −0.465 | 0.338 |
| 0.603 | −0.482 | 0.338 |
| 0.638 | −0.498 | 0.338 |
| 0.669 | −0.512 | 0.338 |
| 0.697 | −0.524 | 0.338 |
| 0.723 | −0.534 | 0.338 |
| 0.746 | −0.544 | 0.338 |
| 0.764 | −0.551 | 0.338 |
| 0.778 | −0.556 | 0.338 |
| 0.789 | −0.561 | 0.338 |
| 0.794 | −0.567 | 0.338 |
| 0.795 | −0.572 | 0.338 |
| 0.795 | −0.575 | 0.338 |
| 0.794 | −0.576 | 0.338 |
| 0.794 | −0.577 | 0.338 |
| 0.794 | −0.577 | 0.338 |
| 0.698 | −0.629 | 1.593 |
| 0.698 | −0.63 | 1.593 |
| 0.697 | −0.632 | 1.593 |
| 0.695 | −0.634 | 1.593 |
| 0.692 | −0.637 | 1.593 |
| 0.683 | −0.64 | 1.593 |
| 0.671 | −0.637 | 1.593 |
| 0.656 | −0.633 | 1.593 |
| 0.637 | −0.629 | 1.593 |
| 0.612 | −0.623 | 1.593 |
| 0.583 | −0.617 | 1.593 |
| 0.552 | −0.61 | 1.593 |
| 0.518 | −0.602 | 1.593 |
| 0.479 | −0.593 | 1.593 |
| 0.437 | −0.582 | 1.593 |
| 0.394 | −0.57 | 1.593 |
| 0.348 | −0.556 | 1.593 |
| 0.301 | −0.541 | 1.593 |
| 0.253 | −0.524 | 1.593 |
| 0.203 | −0.505 | 1.593 |
| 0.152 | −0.485 | 1.593 |
| 0.1 | −0.462 | 1.593 |
| 0.046 | −0.437 | 1.593 |
| −0.007 | −0.41 | 1.593 |
| −0.058 | −0.382 | 1.593 |
| −0.109 | −0.352 | 1.593 |
| −0.16 | −0.321 | 1.593 |
| −0.209 | −0.288 | 1.593 |

TABLE 1-continued

| X-LOC | Y-LOC | Z-LOC |
|---|---|---|
| −0.257 | −0.254 | 1.593 |
| −0.304 | −0.218 | 1.593 |
| −0.349 | −0.18 | 1.593 |
| −0.394 | −0.141 | 1.593 |
| −0.437 | −0.101 | 1.593 |
| −0.479 | −0.059 | 1.593 |
| −0.518 | −0.017 | 1.593 |
| −0.554 | 0.024 | 1.593 |
| −0.587 | 0.066 | 1.593 |
| −0.619 | 0.106 | 1.593 |
| −0.647 | 0.146 | 1.593 |
| −0.674 | 0.186 | 1.593 |
| −0.698 | 0.224 | 1.593 |
| −0.72 | 0.259 | 1.593 |
| −0.738 | 0.292 | 1.593 |
| −0.754 | 0.321 | 1.593 |
| −0.768 | 0.347 | 1.593 |
| −0.779 | 0.371 | 1.593 |
| −0.787 | 0.39 | 1.593 |
| −0.794 | 0.408 | 1.593 |
| −0.8 | 0.422 | 1.593 |
| −0.804 | 0.434 | 1.593 |
| −0.806 | 0.444 | 1.593 |
| −0.807 | 0.452 | 1.593 |
| −0.807 | 0.458 | 1.593 |
| −0.806 | 0.463 | 1.593 |
| −0.804 | 0.467 | 1.593 |
| −0.801 | 0.469 | 1.593 |
| −0.799 | 0.47 | 1.593 |
| −0.795 | 0.47 | 1.593 |
| −0.791 | 0.469 | 1.593 |
| −0.785 | 0.467 | 1.593 |
| −0.779 | 0.464 | 1.593 |
| −0.771 | 0.458 | 1.593 |
| −0.761 | 0.45 | 1.593 |
| −0.75 | 0.441 | 1.593 |
| −0.737 | 0.429 | 1.593 |
| −0.722 | 0.415 | 1.593 |
| −0.704 | 0.398 | 1.593 |
| −0.684 | 0.378 | 1.593 |
| −0.661 | 0.356 | 1.593 |
| −0.635 | 0.331 | 1.593 |
| −0.607 | 0.303 | 1.593 |
| −0.576 | 0.273 | 1.593 |
| −0.544 | 0.241 | 1.593 |
| −0.51 | 0.208 | 1.593 |
| −0.475 | 0.174 | 1.593 |
| −0.438 | 0.14 | 1.593 |
| −0.399 | 0.104 | 1.593 |
| −0.359 | 0.067 | 1.593 |
| −0.317 | 0.029 | 1.593 |
| −0.275 | −0.009 | 1.593 |
| −0.233 | −0.046 | 1.593 |
| −0.19 | −0.083 | 1.593 |
| −0.147 | −0.119 | 1.593 |
| −0.103 | −0.155 | 1.593 |
| −0.058 | −0.19 | 1.593 |
| −0.014 | −0.224 | 1.593 |
| 0.031 | −0.258 | 1.593 |
| 0.077 | −0.291 | 1.593 |
| 0.123 | −0.323 | 1.593 |
| 0.17 | −0.354 | 1.593 |
| 0.216 | −0.384 | 1.593 |
| 0.261 | −0.411 | 1.593 |
| 0.305 | −0.437 | 1.593 |
| 0.347 | −0.462 | 1.593 |
| 0.389 | −0.484 | 1.593 |
| 0.429 | −0.505 | 1.593 |
| 0.467 | −0.524 | 1.593 |
| 0.505 | −0.541 | 1.593 |
| 0.539 | −0.556 | 1.593 |
| 0.571 | −0.569 | 1.593 |
| 0.599 | −0.58 | 1.593 |
| 0.625 | −0.59 | 1.593 |
| 0.648 | −0.598 | 1.593 |
| 0.666 | −0.604 | 1.593 |
| 0.681 | −0.609 | 1.593 |

TABLE 1-continued

| X-LOC | Y-LOC | Z-LOC |
|---|---|---|
| 0.691 | −0.613 | 1.593 |
| 0.697 | −0.619 | 1.593 |
| 0.699 | −0.623 | 1.593 |
| 0.699 | −0.626 | 1.593 |
| 0.698 | −0.628 | 1.593 |
| 0.698 | −0.629 | 1.593 |
| 0.698 | −0.629 | 1.593 |

While the invention has been described in terms of various specific embodiments, those skilled in the art will recognize that the invention can be practiced with modification within the spirit and scope of the claims.

What is claimed is:

1. An airfoil for a stator vane having an uncoated profile substantially in accordance with Cartesian coordinate values of X, Y and Z set forth in Table I carried only to four decimal places wherein Z is a distance from a platform on which the airfoil is mounted and X and Y are coordinates defining the profile at each distance Z from the platform.

2. An airfoil in accordance with claim 1 wherein said airfoil comprises a ninth stage of a compressor.

3. An airfoil in accordance with claim 1 wherein said airfoil profile lies in an envelope within +/−0.160 inches in a direction normal to any airfoil surface location.

4. An airfoil in accordance with claim 1 wherein said airfoil profile facilitates optimizing an aerodynamic efficiency of said airfoil.

5. An airfoil in accordance with claim 1 in combination with a base extending integrally from said platform, said airfoil being formed via a casting process.

6. A compressor comprising at least one row of stator vanes wherein each of said stator vanes comprises a base and an airfoil extending therefrom, at least one of said airfoils having an airfoil shape, said airfoil shape having a nominal profile substantially in accordance with Cartesian coordinate values of X, Y and Z set forth in Table I carried only to three decimal places wherein Z is a distance from an upper surface of said base from which said airfoil extends and X and Y are coordinates defining the profile at each distance Z from said base.

7. A compressor in accordance with claim 6 wherein each said airfoil shape is defined by the profile sections at the Z distances being joined smoothly with one another to form a complete airfoil shape.

8. A compressor in accordance with claim 6 wherein said at least one airfoil further comprises a coating extending upon said at least one airfoil, said coating having a thickness of about 0.100 inches or less.

9. A compressor in accordance with claim 6 wherein said at least one row of stator vanes comprises a ninth stage of said compressor.

10. A compressor in accordance with claim 6 wherein said airfoil profile lies in an envelope within +/−0.160 inches in a direction normal to any airfoil surface location.

11. A compressor in accordance with claim 6 wherein said airfoil shape facilitates improving an operating efficiency of said compressor.

12. A compressor in accordance with claim 6 wherein said airfoil shape facilitates optimizing an aerodynamic efficiency of said airfoil.

13. A compressor in accordance with claim 6 wherein each said stator vane base is cast integrally with a respective one of said airfoils.

14. A stator assembly comprising at least one stator vane comprising a base and an airfoil extending from said base, wherein said airfoil comprises an uncoated profile substantially in accordance with Cartesian coordinate values of X, Y and Z set forth in Table I carried only to three decimal places wherein Z is a distance from an upper surface of said from which said airfoil extends and X and Y are coordinates defining the profile at each distance Z from said base, said profile scalable by a predetermined constant n and manufacturable to a predetermined manufacturing tolerance.

15. A stator assembly in accordance with claim 14 wherein said predetermined manufacturing tolerance is about ±0.160 inches.

16. A stator assembly in accordance with claim 14 wherein said stator assembly forms a portion of a compressor, said stator assembly comprises a portion of a ninth stage of the compressor.

17. A stator assembly in accordance with claim 14 further comprising a coating upon said airfoil, said coating having a thickness of about 0.100 inches or less.

* * * * *